US005547092A

United States Patent [19]

Thompson

[11] Patent Number: 5,547,092

[45] **Date of Patent: * Aug. 20, 1996**

[54] CONTAINER CLOSURE WITH FRANGIBLE BRIDGES

[75] Inventor: Nigel Thompson, Stourbridge, United Kingdom

[73] Assignee: MCG Closures Limited, United Kingdom

[ * ] Notice: The portion of the term of this patent subsequent to Jul. 13, 2010, has been disclaimed.

[21] Appl. No.: 235,211

[22] Filed: Apr. 29, 1994

Related U.S. Application Data

[63] Continuation of Ser. No. 27,752, Mar. 8, 1993, abandoned.

[30] Foreign Application Priority Data

Mar. 12, 1992 [GB] United Kingdom ..... 9205374

[51] Int. Cl.[6] ..... B65D 41/34

[52] U.S. Cl. ..... 215/252

[58] Field of Search ..... 215/252, 253

[56] References Cited

U.S. PATENT DOCUMENTS

| | | | |
|---|---|---|---|
| 4,352,436 | 10/1982 | Chartier et al. | 215/252 |
| 4,526,282 | 7/1985 | Dutt et al. | 215/252 |
| 4,541,536 | 9/1985 | Davis et al. | 215/252 |
| 4,638,917 | 1/1987 | Persch | 215/252 |
| 4,644,278 | 5/1987 | Barriac | 215/252 |
| 4,715,506 | 12/1987 | McLaren | 215/252 |
| 4,828,127 | 5/1989 | Young et al. | 215/252 |
| 4,830,207 | 5/1989 | Battegazzore | 215/252 |
| 4,846,361 | 7/1989 | Haffner | 215/252 |
| 4,899,898 | 2/1990 | Thompson | 215/252 |
| 5,074,425 | 12/1991 | Wüstmann et al. | 215/252 |
| 5,131,550 | 7/1992 | Thompson | 215/252 |

FOREIGN PATENT DOCUMENTS

| | | |
|---|---|---|
| 0306259 | 3/1989 | European Pat. Off. . |
| 0451102 | 10/1991 | European Pat. Off. . |
| 3912137 | 10/1990 | Germany . |

*Primary Examiner*—Sue A. Weaver
*Attorney, Agent, or Firm*—Laubscher & Laubscher

[57] ABSTRACT

The invention provides a container closure molded from a plastics material and comprising a crown, an annular skirt depending from the crown and provided with a screw-thread on its internal surface, a tamper-evident ring connected to the free end of the annular skirt by a series of frangible bridges extending across an axial gap or circumferential line of weakening between the ring and the skirt, the ring having on its inner surface a series of integral radially inwardly projecting protrusions each having a contact surface generally facing the crown, wherein each bridge is formed with a weakened portion in the unscrewing direction, whereby during unscrewing of the closure from a container neck with a security band formation, the fracture of the bridges occurs as a result of tension and shear forces to provide a sequential separation.

7 Claims, 3 Drawing Sheets

CONTAINER CLOSURE WITH FRANGIBLE BRIDGES

This application is a continuation of application Ser. No. 08/027,752, filed Mar. 8, 1993, now abandoned.

BACKGROUND OF THE INVENTION

The present invention relates to container closures particularly to container closures incorporating a tamper-evident ring.

It is well known with closures of this type to provide an annular closure with an annular tamper-evident ring depending from the free end of the closure attached thereto by a plurality of frangible bridges which fracture during removal of the closure from a container neck to which it has been applied, so that the tamper-evident ring is separated from the main body of the closure thereby indicating that the closure has been removed at least once from the container neck.

One of the problems with arrangements of this type is that the frangible bridges do not necessarily break in any particular sequence and indeed in some circumstances do not break at all. In the latter case it is then difficult to remove the container closure from the container neck.

The present invention has as its object the controlled removal of a tamper-evident ring from a closure during unscrewing of the closure from a container neck formed with an annular security band, so that the frangible bridges fracture at least substantially sequentially.

BRIEF DESCRIPTION OF THE PRIOR ART

In DE-A-3912137 there is described a container closure formed of a resilient plastics material and provided with a crown, an annular skirt depending therefrom, and a tamper-evident ring depending from the free end of the annular skirt. The tamper-evident ring is secured to the free end of the annular skirt by means of frangible bridges. The remote end of the tamper-evident ring is provided with a plurality of inturned segments, each segment being provided with an inwardly directed protrusion having a radially and upwardly directed contact face. In use when the closure is disposed upon a container neck the segments are forced outwardly until they seat under an annular security band on the neck of the container.

However, during the unscrewing procedure, the remote end of the tamper-evident ring is deformed outwardly by tension induced between the underside of the annular security band on the container neck and the screw-thread portions as the closure is unscrewed from the container neck. Since the inturned segments depend from the lower-most hinge portion, the contact between the protrusions and the annular security band is irregular. Accordingly, although the frangible bridges securing the tamper-evident ring to the closure will break by virtue of tension, they break in a substantially random manner.

In EP-A-0451102 there is provided an arrangement wherein the frangible bridges are formed between the tamper-evident ring and annular skirt of the closure. The frangible bridges are formed in a teardrop configuration such that they face each other about a point (P) on each side of the closure member. The modus operandi is that by the unscrewing of the closure from the container neck there is an increase in tension between the protrusion on the internal face of the annular security band and the closure to a point wherein the tensional forces exceed the strength of the bridges, whereupon the bridges fracture. The fracture of the bridges commences, of course, at its weakened portion which in both cases is the portion of reduced cross-section when the bridges have a teardrop cross-section. It is important in this disclosure for at least two of the teardrop bridges to face each other so that when they are placed under tension, they are destroyed substantially at the same time, thereby allowing the security band to hang down in a loop.

Whereas this arrangement would work satisfactorily if tension were the only force to be contended with, the effects of shear between the contact faces of the protrusions and the annular security band on the neck of the container, ensure that when one frangible bridge is subjected to substantial destructive forces the opposed frangible bridge is protected from the effects of shear. The effect of this is that whereas eventually the tensional forces between the tamper-evident ring and the closure will cause the frangible bridges to fracture in some order, its actual effect will be to destroy those shaped frangible bridges with a weakened portion in the unscrewing direction first, with the other bridges facing the opposed direction being destroyed subsequently.

The present invention is based on the realization that the shear forces in the closures of this type maybe utilized in some circumstances to ensure a controlled sequential fracture of the frangible bridges in a more reliable way.

SUMMARY OF THE INVENTION

According to a first feature of the invention there is provided a container closure molded from a plastics material and comprising a crown, an annular skirt depending from the crown and formed with a screw-thread on its internal surface and a tamper-evident ring connected to the free end of the annular skirt by a series of frangible bridges extending across an axial gap or by a circumferential line of weakening between the ring and the skirt, the ring having on its inner surface a series of radially inwardly projecting protrusions, each having a contact surface generally facing the crown.

The invention is characterized in that each bridge is formed with a weakened portion in the unscrewing direction, whereby during unscrewing of the closure from a container neck with a security band, the fracture of the bridges occurs as a resultant of tension and shear forces to give a controlled sequential separation.

The tension referred to is substantially that which occurs during unscrewing, between the screw-threads of the closure and the contact faces of the protrusions. Shear is the force generated by the friction between the contact surface of the protrusions and the cooperating surface of the annular security band during the unscrewing process. This frictional force increases with tension upon unscrewing and will be dependent upon the characteristics of the contact surface of the protrusions, and the face of the annular security band on the container neck, and the materials from which the tamper-evident ring is constructed.

In EP-A-0306259 is described a container closure molded from plastics material and comprising a crown, an annular skirt depending from the crown and formed with a screw-thread on its internal surface, and a tamper-evident ring connected to the end of the skirt remote from the crown by a series of frangible bridges extending across an axial gap between the ring and the skirt, the ring having on its inner surface a series of radially inwardly projecting protrusions each having a contact surface generally facing the crown and directed radially inwardly; the ring having an annular groove formed in one of its radially facing surfaces at a position axially between the protrusions and the bridges.

This arrangement provides a hinge portion for the tamper-evident ring and is particularly suited to the arrangement of the present invention. Accordingly, such a measure may be further characterized in that each bridge is formed with a weakened portion in the unscrewing direction, whereby during unscrewing of the closure from a container neck with a security band, the fracture of the bridges is a result of tension and shear forces to give a controlled sequential separation.

In a preferred embodiment of the invention, the weakened portion has a teardrop configuration in cross-section with a narrowest portion facing the direction of unscrewing. However, other configurations are operable; for example triangular or ovoid cross-sectional shapes. Generally speaking however, since the frangible bridges are usually formed of the same material from which the closure is molded, it is necessary to provide an asymmetric configuration to the frangible bridges so that the weakest portion of the bridge breaks first under tensional and shear loads.

The protrusion may be formed in a number of different shapes, for example one of the wedge shapes as shown in EP-A-0306259. However, in a more preferred form of the invention, the protrusions have a compound curve extending downwardly from the contact surface of the protrusion. The compound curve, preferably has its major face formed by the gentler radius, in the screwing-on direction.

In the closures in accordance with the present invention, the number of frangible bridges and the number of protrusions may be the same or different. Where the number of protrusions is greater or less than the number of frangible bridges, the difference is an integer between one and five, and is preferably one.

BRIEF DESCRIPTION OF THE FIGURES

The arrangement will now be described, by way of illustration only, with reference to the accompanying drawings wherein.

DETAILED DESCRIPTION

Figure 1:
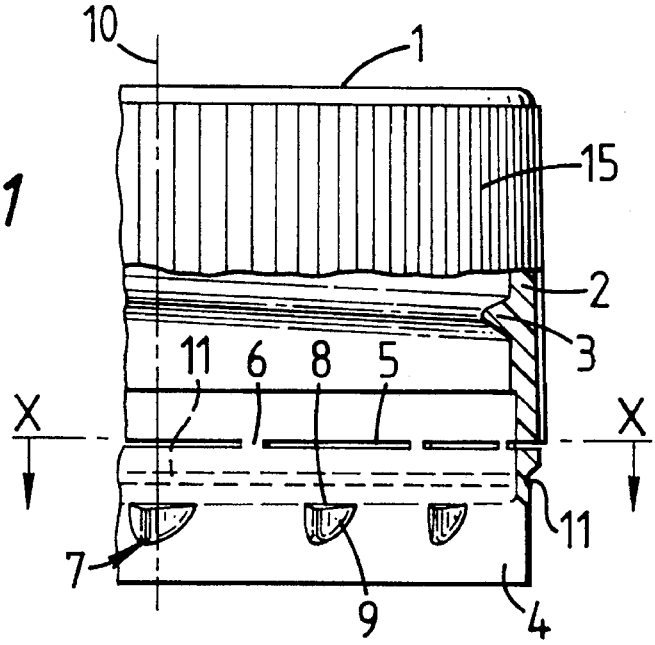
FIG. 1 shows a part sectional elevation of a closure of the invention.

With reference to FIGS. 1 to 5, the closure shown is molded from resilient plastics material and comprises a crown (1), an annular skirt (2) depending from the crown and formed with a screw-thread (3) on its inner surface and a tamper-evident ring (4) spaced from the bottom edge of the annular skirt by an axial gap (5) across which extend frangible bridges (6) molded integrally with the skirt (2) and the tamper-evident ring (4).

The inner surface of the ring (4) has formed upon it a series of circumferentially-spaced axially extending protrusions (7) each having a contact surface (8) upwardly disposed toward the crown, but inclined at a small angle of up to 15° away from the crown in a radially inwardly direction, and having a compound curve (9).

The protrusions (7) are preferably formed with a compound curve (9) and are provided with a gently inclined surface in the screwing-on direction (to the right-hand side of FIG. 1) and a portion of a more exagerated inclination to the left-hand side (the truncated portion) of the compound curve (9) in the unscrewing direction. The protrusions are axially spaced from the gap (5) and an arcuate section groove (11) is formed in the outer surface of the ring (4) at a location axially between the gap (5) and the contact surfaces (8) of the protrusions.

In the particular embodiment of FIG. 1 there is one more frangible bridge (6) than there are protrusions (7) but the number may be equal or quite different depending upon the results required. There may be up to five more bridges than protrusions, or up to five more protrusions than bridges.

Figure 2:
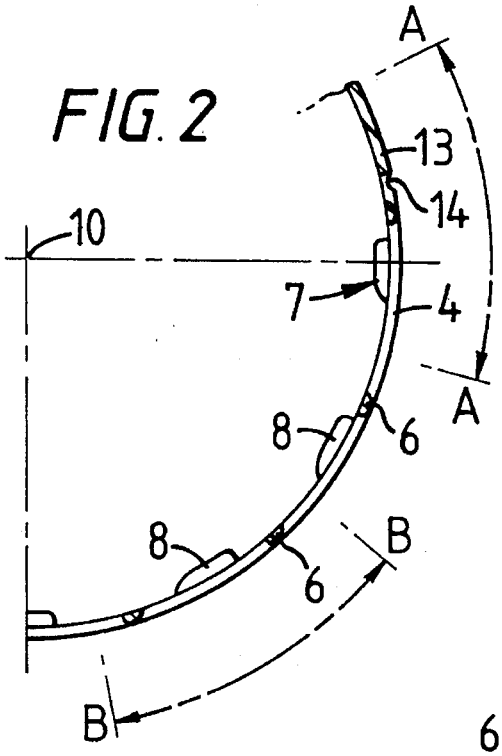
FIG. 2 shows a view from above of a section of a tamper-evident ring separated from the closure of FIG. 1.
Figure 3:
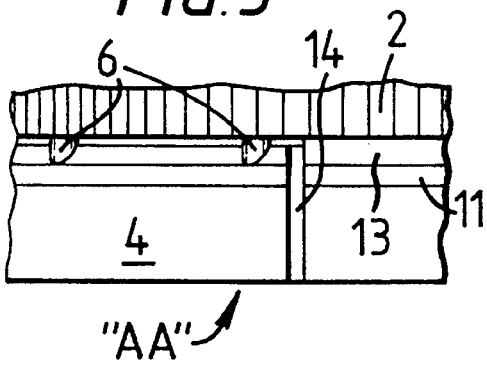
FIG. 3 shows a side view of a section of the closure of the invention over a segment A—A of FIG. 2.

As can be best seen in FIG. 3, the closures in accordance with the present invention may be formed with a solid section (13) which replaces the gap (5) and the frangible bridges (6) over a segment of the closure as shown in "AA" in FIG. 2. The purpose of this arrangement is to provide an axial line of weakness (14) extending from the remote edge of tamper evident band (4) to the annular skirt of the closure (2). This is associated with the solid section (13) whereby the tamper-evident ring (4), after separation of all the frangible bridges, permits the ring (4) to stay attached to the skirt whereby the closure and the tamper-evident ring can be disposed of together. The exterior periphery of the annular skirt (2) may be formed with a plurality of knurls (15) if desired.

Figure 4:
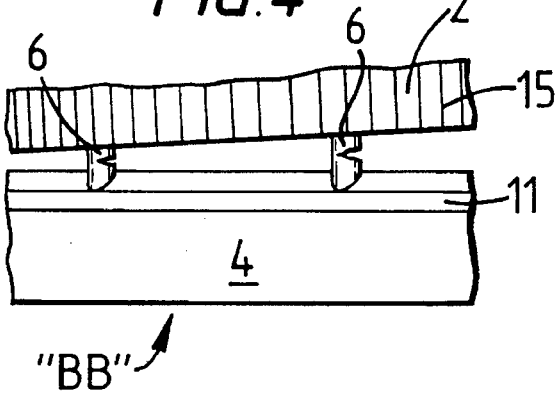
FIG. 4 shows a side view of a section, to an enlarged scale, over segment B—B of FIG. 2 during the unscrewing process.

With reference particular to FIG. 4, when the closure is applied to a screw-threaded container having an annular security band formed with a shoulder at its lower end in a well known manner, the compound curve (9) protrusions come into interengagement with the security band (not shown) and are spread outwardly by the security band causing the tamper-evident ring (4) to expand locally. This process continues until the closure has fully engaged, and the contact faces (8) of the protrusion (7) have come into contact with the underside of the annular security band and cause the ring (4) to contract resiliently.

Figure 5:
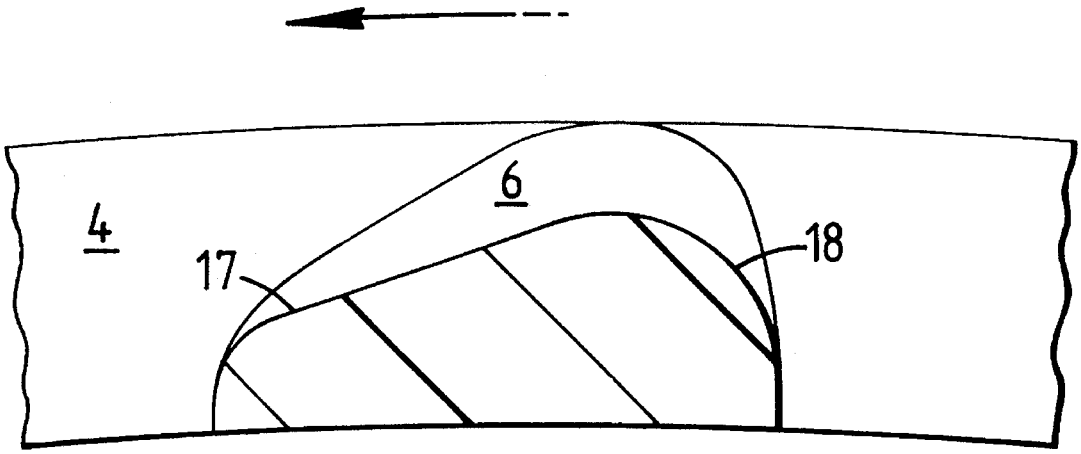
FIG. 5 shows a top plan sectional view of a preferred form of bridge according to this invention.
Figure 6:
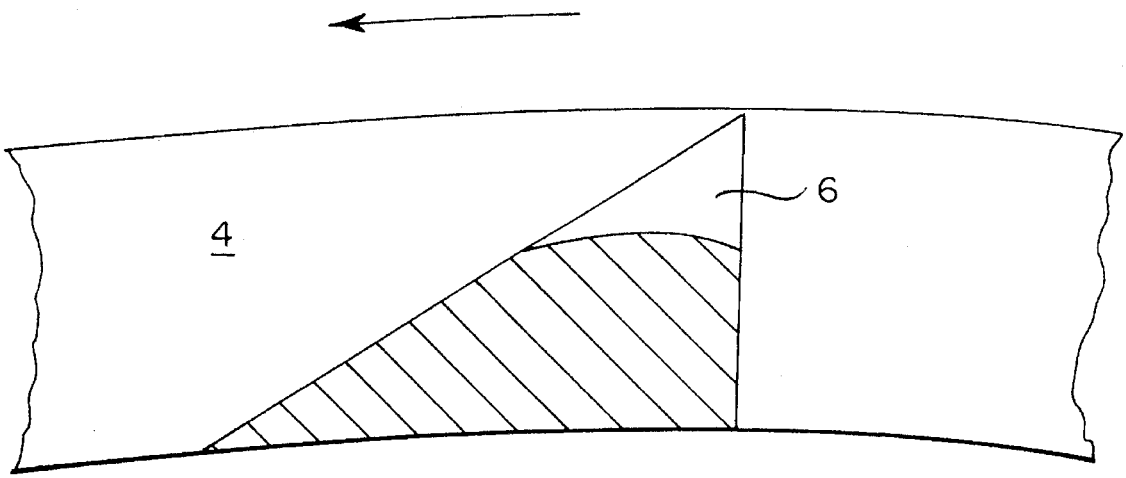
FIGS. 6 and 7 show top plan sectional views of alternative forms of a bridge.
Figure 7:
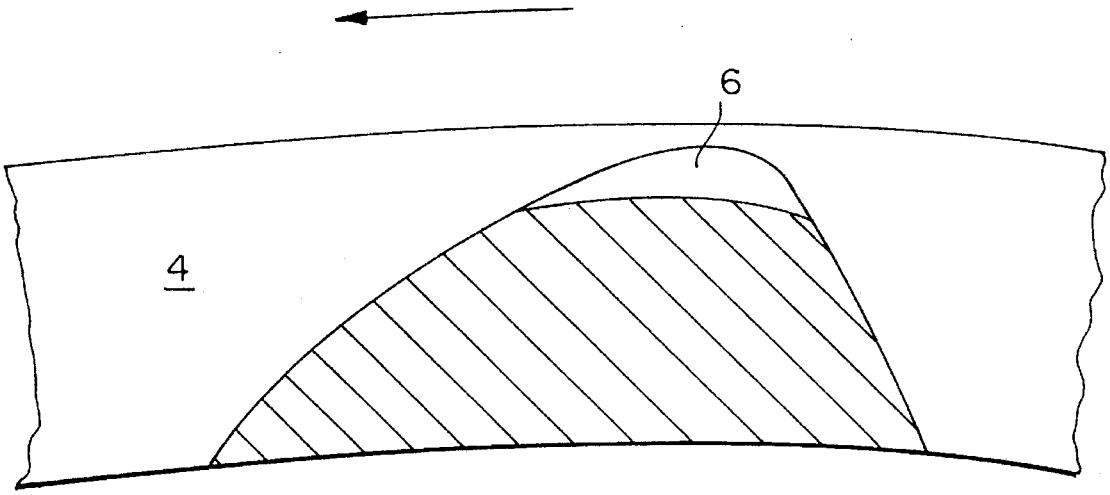

In FIG. 5, a cross sectional view of a frangible bridge (6) having a teardrop configuration is shown from above, to be provided with a weakened edge (17) and stronger portion (18); it will be noted that the frangible bridge (6) extends radially outwardly toward the outer surface of the ring (4). Bridges having triangular configurations are shown in FIGS. 6 and 7, respectively.

In use, when the closure is unscrewed, threads (3) take up on the corresponding screw-thread on the container neck and tension is increased because contact faces (8) of the protrusions (7) are locked against the lower shoulder of the annular security band on the container neck, while the screw-thread portions (3) are riding up the screw-thread portion on the neck of the container as the container closure is rotated in the unscrewing direction.

It will be appreciated that as the tensional forces increase during the unscrewing procedure shear forces will be generated between the contact surfaces (8) of the protrusions (7) and the shoulder portion of the annular security band. These forces combine to have the effect of causing the tamper-evident ring to tend to rotate more slowly than the speed of rotation of the annular skirt, exerting a breaking force upon the weaker section of the frangible bridges (6).

The frangible bridges (6) are formed of a teardrop configuration having their weakest edge (17) presented to the unscrewing direction. It follows that the arrangement as shown in FIGS. 4 and 5 rapidly occurs where a first of the frangible bridges (6) is destroyed, as hereinbefore described, as the screw-thread (3) rides up the corresponding screw-thread on the container neck. With the first of the frangible bridges (6) destroyed similar shear forces are applied to the next succeeding frangible bridge which is already weakened, and which is further acted upon by the momentary transfer to the next bridge of the residual load previously absorbed by the first bridge which is released by breakage of said first frangible bridge.

By means of this arrangement, frangible bridges fracture sequentially in a regular fashion, whereby it is possible by careful molding techniques to ensure that in a substantial majority of cases, closures in accordance to the present invention when applied to a container neck will separate as intended.

The solid section (13) may intervene in a sequential fracture of the frangible bridges (6). Obviously the solid section (13) is designed not to fracture and it has a certain level of axial resilience, particularly when associated with the annular groove (11) which can act to provide the axial resilience. Accordingly, the next succeeding annular bridge (6) adjacent the end of the solid section (13) will fracture in exactly the same way.

With all the frangible bridges destroyed the skirt and crown portion of the closure (1) continue to be rotated up the container neck while the tamper-evident ring (4) is retained by the shoulder of the annular security band on the neck of the container. The result is a destruction of the axial line of weakness (14) best shown in FIGS. 2 and 3 allowing the ring to float free except where conjoined to the solid section (13) at its remote end.

The invention therefore relates to container closures with a controlled tamper-evident ring separation facility.

What is claimed is:

1. A container closure molded from plastics material, comprising (a) a crown;

(b) an annular skirt depending from said crown and having a screw-thread on an,internal surface thereof;

(c) said skirt containing a circumferential line of weakness to define a tamper-evident ring depending from said skirt, said line of weakness including a plurality of spaced frangible bridges adapted to transmit rotational forces arising between said ring and said skirt during onscrewing process and for connecting said ring with said skirt;

(d) a plurality of integral protrusions extending radially inwardly from an inner surface of said ring, each of said protrusions having a contact surface facing said crown and including a compound curve extending downwardly from said contact surface; and (e) each of said bridges comprising in cross section a weakened portion whose radial extent decreases in an unscrewing direction of the closure towards a leading edge, whereby during unscrewing of the closure from a container neck having a plain security band, said bridges are sequentially fractured as a result of tension and shear forces created in the line of weakness owing to engagement of said protrusions with the security band of the container neck.

2. A container closure as defined in claim 1, wherein said line of weakness comprises a plurality of gaps, said bridges extending Between said gaps.

3. A container closure as defined in claim 2, wherein said weakened portion comprises one of a teardrop, triangular, and ovoid configurations with a narrower portion thereof facing the unscrewing direction.

4. A container closure as defined in claim 2, wherein said ring contains an annular groove in an outer surface thereof, said groove being axially arranged between said protrusions and said bridges.

5. A container closure as defined in claims 2, wherein said ring contains an axial line of weakness between said gaps and a remote end of said ring, and further comprising means for retaining said ring on the closure following removal of said closure from the container.

6. A container closure molded from plastics material, comprising (a) a crown;

(b) an annular skirt depending from said crown and having a screw-thread on an internal surface thereof;

(c) said skirt containing a circumferential line of weakness comprising a plurality of gaps to define a tamper-evident ring depending from said skirt, said line of weakness including a plurality of spaced frangible bridges extending between said gaps and adapted to transmit rotational forces arising between said ring and said skirt during an onscrewing process and for connecting said ring with said skirt;

(d) a plurality of integral protrusions extending radially inwardly from an inner surface of said ring, said plurality of protrusions being equal in number to said plurality of bridges, each of said protrusions having a contact surface facing said crown and including a compound curve extending downwardly from said contact surface; and (e) each of said bridges comprising in cross section a weakened edge which is thinner than a broader remaining portion thereof, said weakened edge being arranged in a surface of said bridge facing in an unscrewing direction of the closure and said broader remaining portion of said bridge facing in an onscrewing direction of the closure, whereby during unscrewing of the closure from a container neck having a plain security band, said bridges are sequentially fractured as a result of tension and shear forces created in the line of weakness owing to engagement of said protrusions with the security band of the container neck.

7. A container closure molded from plastics material, comprising (a) a crown;

(b) an annular skirt depending from said crown and having a screw-thread on an internal surface thereof;

(c) said skirt containing a circumferential line of weakness comprising a plurality of gaps to define a tamper-evident ring depending from said skirt, said line of weakness including a plurality of spaced frangible bridges extending between said gaps and adapted to transmit rotational forces arising between said ring and said skirt during an onscrewing process and for connecting said ring with said skirt;

(d) a plurality of integral protrusions extending radially inwardly from an inner surface of said ring, the number of one of said bridges and protrusions exceeding the other of said bridges and protrusions by an integer between 1 and 5, each of said protrusions having a contact surface facing said crown and including a compound curve extending downwardly from said contact surface; and (e) each of said bridges comprising in cross section a weakened edge which is thinner than a broader remaining portion thereof, said weakened edge being arranged in a surface of said bridge facing in an unscrewing direction of the closure and said broader remaining portion of said bridge facing in an onscrewing direction of the closure, whereby during unscrewing of the closure from a container neck having a plain security band, said bridges are sequentially fractured as a result of tension and shear forces created in the line of weakness owing to engagement of said protrusions with the security band of the container neck.

* * * * *